US008622332B2

(12) United States Patent
Bologna

(10) Patent No.: US 8,622,332 B2
(45) Date of Patent: Jan. 7, 2014

(54) STRETCH FILM HANDLE

(75) Inventor: James Apap Bologna, Sarasota, FL (US)

(73) Assignee: Intertape Polymer Corp., Bradenton, FL (US)

( * ) Notice: Subject to any disclaimer, the term of this patent is extended or adjusted under 35 U.S.C. 154(b) by 391 days.

(21) Appl. No.: 12/910,789

(22) Filed: Oct. 23, 2010

(65) Prior Publication Data

US 2011/0095123 A1 Apr. 28, 2011

Related U.S. Application Data

(60) Provisional application No. 61/254,231, filed on Oct. 23, 2009.

(51) Int. Cl.
*B65H 59/04* (2006.01)

(52) U.S. Cl.
USPC ..... 242/588.2; 242/422.4

(58) Field of Classification Search
USPC ..... 242/422.4, 422.5, 588, 588.2, 597.6, 242/423.1
See application file for complete search history.

(56) References Cited

U.S. PATENT DOCUMENTS

| | | | | |
|---|---|---|---|---|
| 4,179,081 | A | 12/1979 | Parry | |
| 4,248,392 | A | 2/1981 | Parry | |
| 4,477,037 | A | 10/1984 | Goldstein | |
| 4,484,717 | A | 11/1984 | Goldstein | |
| 4,530,473 | A | 7/1985 | Parry | |
| 4,535,951 | A | 8/1985 | Riemenschneider, III | |
| 4,575,020 | A | 3/1986 | Strout et al. | |
| 4,600,163 | A | 7/1986 | Hummel et al. | |
| 4,659,031 | A | 4/1987 | Saraisky | |
| 4,714,211 | A | 12/1987 | Hwang | |
| 4,722,493 | A | 2/1988 | Parry et al. | |
| 4,784,348 | A * | 11/1988 | McDonald | 242/422.4 |
| 4,834,312 | A | 5/1989 | Riemenschneider, III | |
| 4,872,623 | A | 10/1989 | Parry et al. | |
| 5,203,517 | A | 4/1993 | Parry et al. | |
| 5,351,905 | A | 10/1994 | Ferber | |
| 5,915,642 | A | 6/1999 | Davis | |
| 6,102,323 | A | 8/2000 | Riemenschneider | |
| 6,508,430 | B1 | 1/2003 | Rodriguez | |
| 6,517,023 | B2 * | 2/2003 | Rodriguez | 242/422.4 |
| 7,380,744 | B1 | 6/2008 | Yu Chen | |
| 7,552,891 | B2 * | 6/2009 | Huang | 242/588.2 |
| 7,726,600 | B2 * | 6/2010 | Huang | 242/588.2 |
| 7,937,915 | B2 * | 5/2011 | Kohn et al. | 242/422.4 |
| 2008/0072538 | A1 | 3/2008 | Kohn et al. | |

* cited by examiner

*Primary Examiner* — William A Rivera
(74) *Attorney, Agent, or Firm* — Thompson Hine L.L.P.

(57) ABSTRACT

An apparatus for dispensing a roll of material with one hand is disclosed that includes a shaft having a core segment for supporting a roll of material and a handle segment that is integral with the core segment. The handle segment has an annular recess with a collar received therein. The apparatus includes a gripper received over the handle segment of the shaft. The gripper has a cylindrically shaped body defining an open center that has an open upper end and a closed lower end. The gripper is positioned on the handle segment with its open upper end between the collar and the core segment. The shaft is rotatable relative to the gripper and the gripper is hand-compressible to bring the gripper into frictional contact with the shaft to slow or stop the rotation of the shaft.

20 Claims, 5 Drawing Sheets

STRETCH FILM HANDLE

This application claims the benefit of U.S. provisional Application No. 61/254,231, filed Oct. 23, 2009.

FIELD OF THE INVENTION

This invention relates generally to a tool for dispensing a roll of stock material. More particularly, the invention relates to tool for manually dispensing and applying an elongated flexible stock material with one hand.

BACKGROUND

In shipping and storing goods, a flexible stock material such as a plastic stretch film can be used to protect and secure a load. The advantages of the use of stock materials are numerous. The stock material produces a tight wrap and protects the wrapped load from damage due to weather, abrasions, punctures, and the like.

To utilize the stock material in an optimum manner, the material must be applied to the load at an appropriate tension. If the material is stretched too tight, the material will be difficult to wrap about the load and may break or tear. If the tension in the material is insufficient, the material will not conform to the shape of the load and the material wrap will be undesirably loose.

A number of devices have been developed for controlling the tension applied to the stock material during application of the material to a load. U.S. Pat. Nos. 4,722,493; 4,834,312; 4,872,623 and 5,203,517 show examples of such devices. For instance, U.S. Pat. No. 4,834,312 discloses a device having a head of a size and shape to be inserted into a core. Fixedly projecting from the head is a handle in the form of a spindle. The spindle carries a flexible grip in which the spindle normally freely rotates and which the flexible grip may be selectively squeezed to vary the friction between the grip and the spindle, thus varying the tension in the stock material being applied. Specifically, the grip includes a split cylindrical member telescoped over the spindle. Insertable devices, such as disclosed in these patents, often have multiple pieces most of which are plastic. The complexity of these designs and even the use of plastic increase their cost.

U.S. Pat. No. 6,102,323 discloses a web dispensing tool that has an elongate shaft rather than an insertable dispensing handle. The disclosed design includes a gripper with a sleeve fitted inside it that makes the gripper generally rigid so that tightening the grip on the gripper does not affect (slow or stop) the rotation of the shaft. Instead, when the user wants to tension the film by slowing the motion of the handle the user must move his thumb and forefinger to squeeze a recess portion of the gripper into a groove in the shaft for frictional braking. This design purposely avoids locating the tensioning/braking mechanism in the main portion of the gripper.

SUMMARY

In one aspect, a dispensing tool with minimal number parts, many of which are reusable and/or recyclable, is disclosed that is easily operated by one hand with the tensioning/braking mechanism located in the main portion of the gripper. The dispending tool or apparatus includes a shaft that has a core segment for supporting a roll of material and a handle segment that is integral with the core segment, the handle segment having an annular recess therein, a collar received in the annular recess, and a gripper comprising a generally cylindrically shaped body having an open center and an open upper end and a closed lower end, the gripper being positioned on the handle segment with the open upper end between the collar and the core segment. The shaft of the apparatus is rotatable relative to the gripper and the gripper is hand-compressible to bring the gripper into frictional contact with the shaft to slow or stop the rotation thereof.

In one embodiment, the shaft is a corrugated paper shaft. In another embodiment, the shaft may include a roll of stock material wound onto the core segment to be dispensed when the shaft rotates, such as a roll of stretch wrap film.

In another aspect an apparatus for dispensing a roll of material with one hand is disclosed that includes a shaft having a core segment for supporting a roll of material integral with a handle segment that includes a groove and a washer channel with the groove positioned nearer to the core segment than the washer channel. The apparatus also includes an elastomeric washer received in the washer channel and a gripper received over the handle segment of the shaft. The gripper includes a cylindrically shaped body defining an open center and having an open upper end and a closed lower end. When the gripper is slide over the handle segment its open upper end passes over the elastomeric washer and is received in the groove on the handle segment of the shaft. The shaft is rotatable relative to the gripper and the gripper is hand-compressible to bring the gripper into frictional contact with the washer to slow or stop the rotation of the shaft.

In one embodiment, the shaft may include a roll of stock material wound onto the core segment to be dispensed when the shaft rotates, such as a roll of stretch wrap film.

BRIEF DESCRIPTION OF THE DRAWINGS

The features and inventive aspects of the embodiments disclosed herein will become more apparent upon reading the following detailed description, claims and drawings, of which the following is a brief description:

DESCRIPTION

Figure 1:
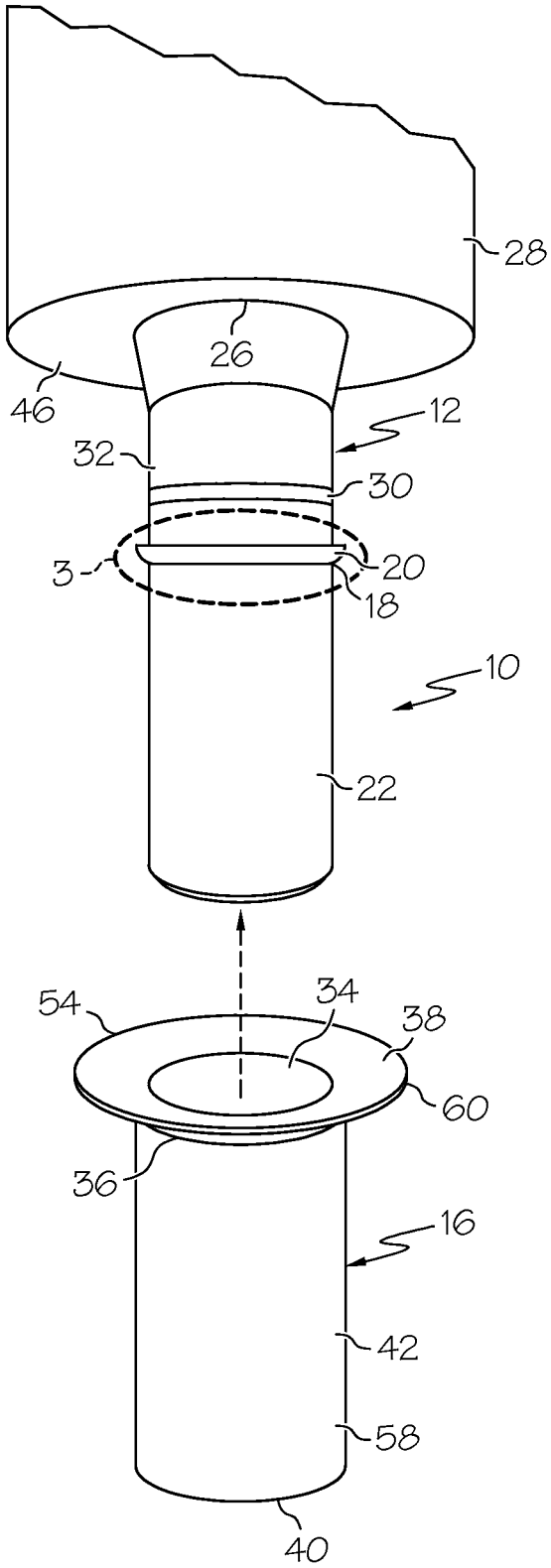
FIG. 1 is an exploded perspective view of one embodiment of a dispensing tool.

The following detailed description will illustrate the general principles of the invention, examples of which are additionally illustrated in the accompanying drawings. In the drawings, like reference numbers indicate identical or functionally similar elements.

Figure 3:
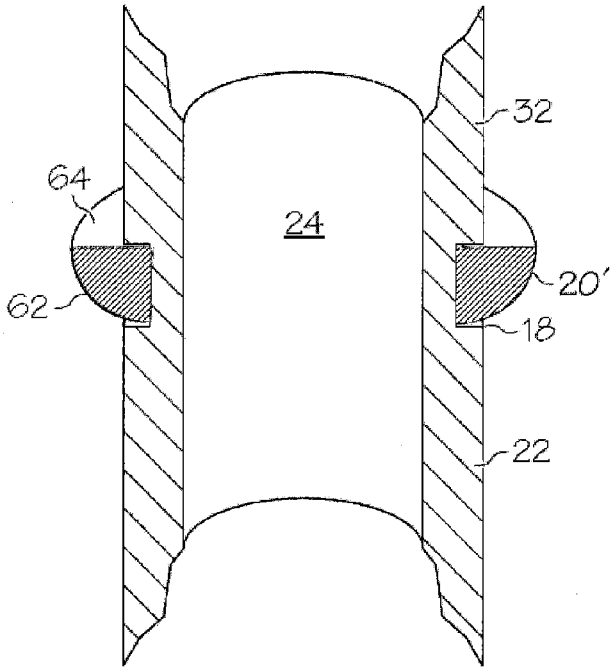
FIG. 3 is an enlarged cross-sectional view of the portion of the core showing the washer and washer channel inside the circle 3 in FIG. 1.
Figure 4:
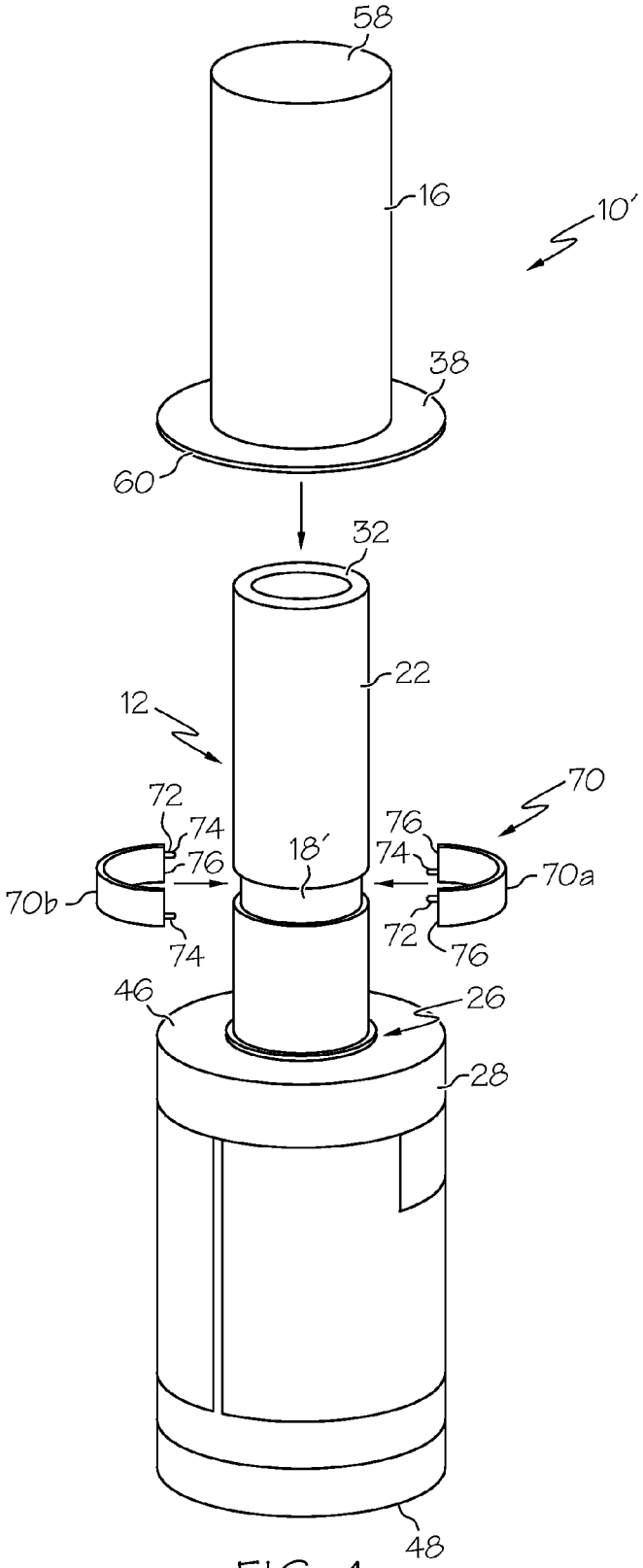
FIG. 4 is a pre-assembly perspective view of one embodiment of a dispensing tool.
Figure 5:
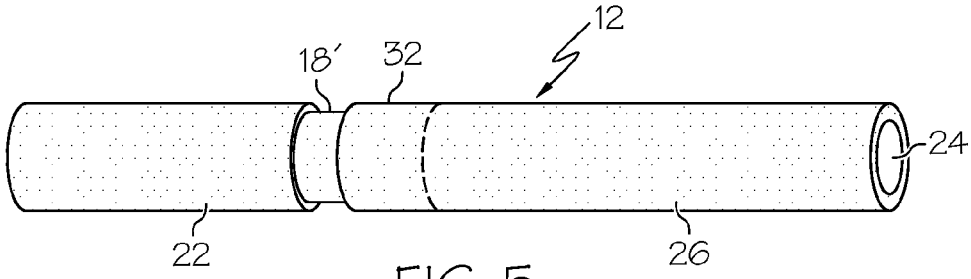
FIG. 5 is a side view of a shaft having a groove therein for receiving a collar.
Figure 5A:
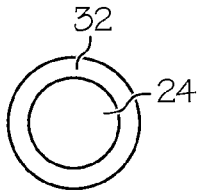
FIG. 5A is an end view of the core segment of the shaft

FIGS. 1 and 4 show embodiments of a dispensing tool 10 and 10', respectively, that are assembled by sliding a gripper 16 over a handle segment 22 of a shaft 12. The shaft 12 includes a cylindrical body 32 surrounding a hollow center 24 as best seen in FIGS. 2-3, 5 and 5A. The shaft 12 includes two segments, a core segment 26 and a handle segment 22, that are integral with one another. The core segment 26 defines one end of the shaft 12 and the handle segment 22 defines the other end. The core segment 26 supports a roll 28 of stock material having an inner end 46 and an outer end 48 (best seen in FIG. 4), for example a stretch film, and the handle segment 22 receives the gripper 16. The core segment 26 stops and the handle segment 22 begins at the inner end 46 of the roll 28. The core segment 26 and the handle segment 22 may be the same or different lengths, relative to one another.

The shaft 12 has a rigid construction such that the core segment 26 does not readily deform or break upon application of bending or compressive forces. The shaft 12 is fabricated of a plurality of concentrically wound layers of a paper or plastic material. The layers of the paper material are bonded together using a suitable adhesive in conventional fashion. Additionally, the paper material has the consistency of paper board material known and used in the industry for cores designed to support paper or plastic products, often referred to as a corrugated core. The paper board core may be preferable because it is biodegradable and/or recyclable and will contribute plastic to land fills.

Figure 2:
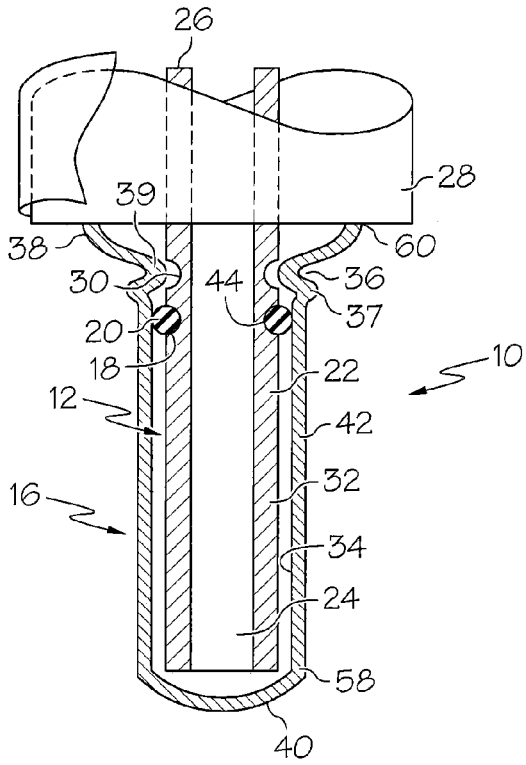
FIG. 2 is a front cross-sectional view of one embodiment of a dispensing tool.

Now referring to the embodiment of FIGS. 1-3, the handle segment 22 has a first annular recess 18 and a second annular recess 30. In one embodiment, the second annular recess 30 may be located in a generally central portion of the shaft 12 in close proximity to the roll 28 of stock material. It is appreciated that the second annular recess 30 may be located at other points along the shaft 12. The first annular recess 18 is adjacent the second annular recess 30 with the second annular recess 30 positioned nearer to the core segment 26 or the roll 28 than the first annular recess 18.

The first annular recess 18 is generally wider than the second annular recess 30 and may be cut, milled, or machined into the core, as shown in FIG. 3, but is not limited thereto. The second annular recess 30 may be a depression that is cut, milled, pressed, or machined into the core, but is not limited thereto. It is possible that the first annular recess 18 may also be pressed into the core, but as the recess increases in width this may become a less desirable option. One skilled in the art will appreciate that other methods of making the first and/or the second annular recesses 18, 30 are possible.

In one embodiment, the first annular recess 18 provides a seat for a collar 20 and is preferably made into the shaft 12 to a depth suitable therefore. In one embodiment, the first annular recess 18 is deeper than the second annular recess 30. The collar 20, as shown in FIGS. 1-3, is seated in the first annular recess 18. The collar 20 act as a backstop for the gripper 16 once the tool 10 is assembled that prevents the gripper 16 from sliding back off the handle segment 22. In one embodiment, the collar 20 may be or include a washer such as an elastomeric washer. The elastomeric washer should be stretchable enough to fit over the shaft 12 and thick enough to seat within the first annular recess 18 with a portion thereof extending out of the first annular recess. One of skill in the art will appreciate that the elastomeric washer may be made of or include any elastomer suitable for frictional engagement with the gripper 16. For example, the washer may be or include neoprene, natural rubber, or pliable PVC, but is not limited thereto. In one embodiment, the washer may be a standard toroidal-shaped washer, such as an O-ring. In another embodiment, as seen in FIG. 3, the washer may be a quarter-quadrant washer, i.e., a ¼ segment of a toroidal-shaped washer 20'.

The gripper 16 provides a support surface for a user's hand during manipulation of the tool 10. The gripper 16 is preferably molded of a soft pliable plastic material such a polyvinyl chloride, polyvinylidene chloride, thermoplastic rubber resins, or a material of similar characteristics that enables the gripper to flex in response to the pressure applied by the user's hand. Preferably, the gripper 16 is molded of PVC. The gripper 16 can alternately be made of a pliable paperboard. The embodiments, herein provide a gripper that is removable and reusable with subsequent rolls of stock material. Such grippers are better for the environment as they are less likely to be discarded and end up in a land fill.

The gripper 16 includes a cylindrical body 42 defining an open center 34, as shown in FIGS. 1-2. The open center 34 is closed at one end 58 by an integrally formed cap 40 while the opposite end 60 is open. The gripper 16 also includes a generally circumferential indentation 36 in the exterior surface of the gripper near the open end 60. The indentation 36 forms a protrusion 39 into the open center 34 of the gripper to define a narrower opening 44 therein. The top edge of the recessed portion 36 is contiguous with an outwardly projecting flange 38. The lower edge of the recessed portion 36 may adjoin an annular projection 37 having an arcuate cross-sectional shape and projecting outwardly from the recessed portion 36.

The flange 38 extends around the outer periphery of the upper end 60 of the gripper 16, providing a barrier between the bottom portion of the roll 28 of stock material and the user's hand. The flange 38 includes an upwardly extending lip 54. The lip 54, in an embodiment where the upper end 60 of the gripper 16 is in general contact with the roll 28 as seen in FIG. 2, can act as a bearing surface against which the roll 28 rotates. In another embodiment, the upper end 60 of the gripper 16 does not contact the roll 28 and instead is separated from the roll be a length of shaft as would be true in an assembled version of FIG. 1.

Upon assembly, the shaft 12 receives the collar 20 in the first annular recess 18 and then the gripper 16 is slide over the handle segment 22 of the shaft 12 until the protrusion 39 passes over the collar 20 and is optionally received in the second annular recess 30. The protrusion 39 acts as a bearing surface or a hub about which the shaft rotates. As seen in FIG. 2, the handle segment 22 is received in the open center 34 of the gripper 16 with enough space between the gripper and the shaft to permit the shaft to rotate freely therein. Additionally, there is a space between the gripper 16 and the collar 20 to permit the shaft to rotate freely until increased pressure is applied to the gripper 16 to cause the gripper to flex inward into frictional engagement with the collar 20, which allows the user to take tension on the stretch film thereby putting into action the film's stretch ability. The gripper 16 is not in constant contact with the collar 20 unless sufficient pressure is applied to warrant that contact.

The collar 20 also keeps the gripper 16 from sliding off the handle segment 22 of the shaft 12 after assembly. The collar 20 extends out from the shaft 12 far enough to provide a ledge or backstop that the protrusion 39 of the gripper 16 would encounter if trying to slide off the handle segment 22. In one embodiment, as shown in FIG. 3, the collar 20 may be a quarter-quadrant washer 20'. The rounded lower surface 62 facing the oncoming gripper 16 facilitates sliding the narrowed opening 44 of the gripper 16 over the collar 20 and the flat or planar upper surface 64 prevents the gripper 16 from sliding off the handle segment 22.

The embodiment in FIG. 4, similar to FIG. 1, includes a circumferentially extending first annular recess 18' in the handle segment 22 positioned such that the gripper 16 slides over the handle segment and receives the first annular recess 18' inside the gripper. It is appreciated that the first annular recess 18' may be located at various points along the shaft 12, but should be close enough to the core segment 26 and the roll 28 to provide the user with adequate control of the dispensing tool, especially for one-hand operation. In one embodiment, the first annular recess 18' is positioned such that the flange 38 of the open end 60 of the gripper 16 is juxtaposed to the roll 28 when assembled, as illustrated in FIG. 2, with enough space between the gripper 16 and the shaft 12 to permit the shaft 12 to rotate freely therein. The first annular recess 18' may be a depression that is pressed or milled into the core in the shape of a ring. One skilled in the art will appreciate that other methods of making the first annular recess 18' in shaft 12 are possible.

First annular recess 18' receives collar 70 seated therein. Collar 70 acts as a bearing surface or a hub about which shaft 12 rotates within the gripper 16 as a user dispenses the stock material from the roll 28. Collar 70 may also act as a backstop that prevents the gripper 16 from sliding off the handle segment 22 after assembly.

Figure 6:
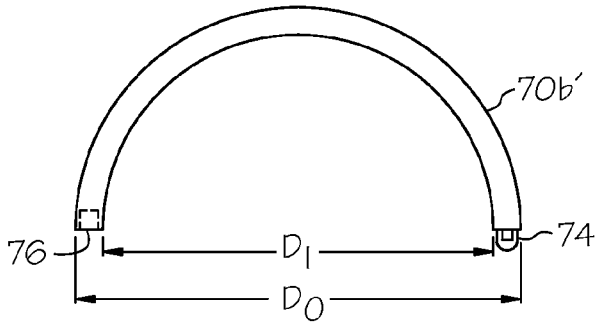
FIG. 6 is a top plan view of one half of a collar.

As shown in FIG. 4, collar 70 includes at least a first collar segment 70*a* and a second collar segment 70*b* that are mateable with one another to form a collar about shaft 12. In particular, the first and second collar segments 70*a*, 70*b* form a substantially circular ring that seats within first annular recess 18'. In the embodiment of FIG. 4, the first and second collar segments 70*a*, 70*b* both may be semicircular as shown in FIG. 6. In another embodiment, the first and second collar segments 70*a*, 70*b* may form un-equal portions of the collar.

As shown in FIG. 4, each collar segment 70*a*, 70*b* may include at least one member 72 for mating the segments together to form the collar 70. In one embodiment, the collar segments 70*a*, 70*b* are releasably mated. Releasably mated segments allow the gripper 16 and collar 70 to be reusable on another shaft 12, for example, once roll 28 is empty or on a roll of a different stock material. In one embodiment, the first and second collar segments 70*a*, 70*b* include at least one set of male and female mating members 74, 76 to mate their respective ends together with the male mating member 74 and the female mating member 76 being opposite one another on different collar segments. In another embodiment, each collar segment 70*a*, 70*b* may include a plurality of male and female mating members 74, 76 at their respective ends. As shown in FIG. 4, each collar segment 70*a*, 70*b* may include one male and one female mating member on one or both end thereof.

Figure 7:
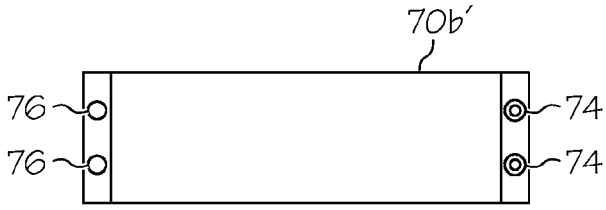
FIG. 7 is an inside front view of one half of the collar of FIG. 6.

Alternately, the collar segments 70*a*, 70*b*, as illustrated in FIGS. 6 and 7 for collar segment 70*b*', may have two female mating members 76 at one end and two male members 74 at the other end. The collar segment 70*b*' is also illustrated as being semi-circular. The members 72 have been illustrated and described as being male and female mating members 74, 76, but the means for mating the collar segments together is not limited thereto. The collar segments 70*a*, 70*b* may be mated by an adhesive, a weld, a press-fit feature, a latch and/or other types of fasteners. Each collar segment, as shown for segment 70*b*' in FIG. 6, has an inner diameter $D_I$ and an outer diameter $D_O$. The collar segments 70*a*, 70*b*, are preferably of uniform dimensions (i.e., thickness or of uniform inner and outer circumferences) such that the collar segments when assembled provide a uniform inner and outer diameter $D_I$ and $D_O$ over the length of the collar.

Figure 8:
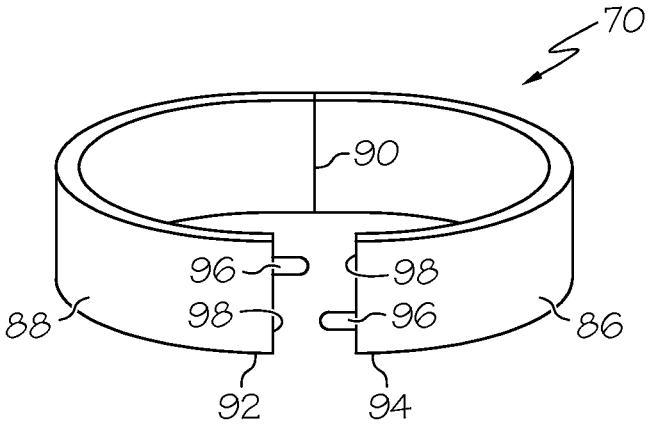
FIG. 8 is side perspective view of one embodiment of a collar.

Referring now to FIG. 8, in another embodiment, the collar 70 may be formed of a plurality of collar segments 86, 88 hingedly attached to one another at hinge 90. The collar segments 86, 88 are mateable at a first end 92 and a second end 94 to form collar 70, which may be substantially circular. The collar segments 86, 88 may be mateable by one or more combinations of male and female mating members 96, 98, as described above, but is not limited thereto.

Figure 9:
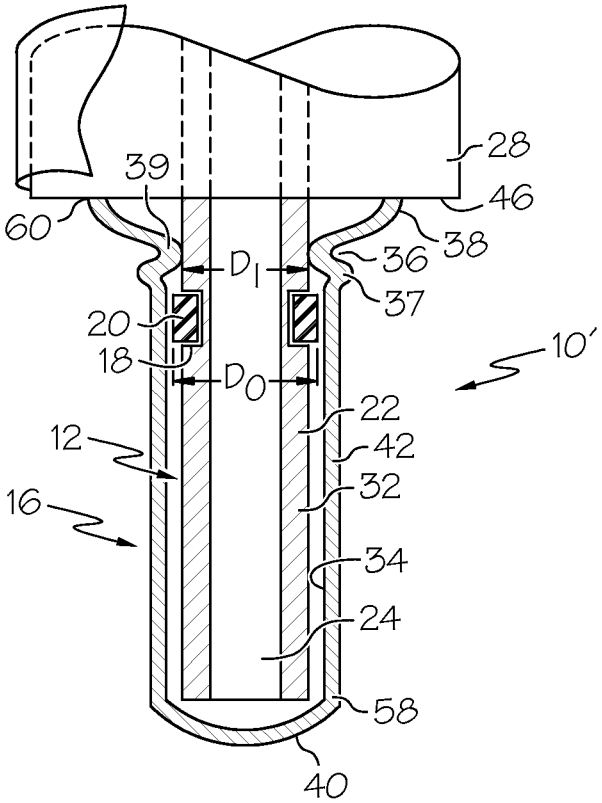
FIG. 9 is a front cross-sectional view of one embodiment of a dispensing tool.

Upon assembly, as illustrated in FIG. 9, the shaft 12 receives the collar segments 70*a* and 70*b* in the first annular recess 18' to form the collar 70. Then, the gripper 16 is slid over the handle segment 22 of the shaft 12 with the open end 60 of the gripper 16 passing over the collar 70 and being juxtaposed to the inner end 46 of roll 28. The outer diameter $D_O$ of the collar 70 is larger than the outer diameter $D_1$ of the portion of shaft 12 that is between the first annular recess 18' and the inner end 46 of the roll 28. The gripper 16 is positioned such that the circumferential indentation 36 in the exterior surface of the gripper and its corresponding inwardly extending protrusion 39 are between the inner end 46 of the roll 28 and the collar 70. Accordingly, collar 70 prevents the gripper 16 from sliding away from the roll 28 and off of the handle segment 22.

In use, the stock material is drawn from roll 28 of one of the dispensing tools disclosed herein. The user manipulates the dispensing tools 10 or 10' by wrapping one hand around the outer periphery of the gripper 16 and dispenses the stock material by placing the leading edge of the film on a surface to be covered or wrapped with the stock material. The user dispenses the desired amount of film by moving the tool 10 or 10' along the surface to be covered, causing the roll 28 to rotate. The shaft 12, in particular the handle segment 22, rotates freely in the open center 34 of the gripper 16 relative to the gripper 16 itself.

To slow or stop the rotation of the roll 28, the user simply increases his grip on the gripper 16, thereby increasing the inwardly directed pressure on the gripper 16 which will bring the gripper 16 into frictional contact with the shaft 12. By slowing the rotational motion of the roll 28, the user varies the tension applied to the stock material. Consequently, the user can control the amount of tension applied on the stock material as the film is dispensed simply by varying (i.e., loosening or tightening) their grip on the gripper 16. Upon stopping the rotation of the roll 28, the user can easily sever the unwound stock material from the roll 28 by moving the tool 10 or 10' away from the unwound stock material that is wrapped around a desired object(s) and causing the stock material to stretch, deform and eventually separate from the roll 28 or by cutting or tearing the stock material.

The disclosed embodiments have been provided to illustrate the invention. There are a variety of configurations that may be employed to fabricate the dispensing tool 10. Therefore, the disclosed embodiment is not intended to limit the scope and spirit of the invention. Consequently, the invention should be limited only by the appended claims.

What is claimed is:

1. An apparatus for dispensing a roll of material with one hand, the apparatus comprising:

a shaft comprising a core segment for supporting a roll of material and a handle segment that is integral with the core segment, the handle segment comprising an annular recess therein;

a collar received in the annular recess and generally non-rotatably attached to the handle segment; and a gripper comprising a generally cylindrically shaped body having an open center and an open upper end and a closed lower end, the gripper being positioned on the handle segment with the open upper end between the collar and the core segment;

wherein the shaft and collar are rotatable relative to the gripper and the gripper is hand-compressible to bring the gripper into frictional contact with the shaft to slow or stop the rotation thereof.

2. The apparatus of claim 1 wherein the shaft is a corrugated paper shaft.

3. The apparatus of claim 1 wherein the open upper end of the gripper includes a protrusion into the open center of the gripper to define a narrower opening therein.

4. The apparatus of claim 3 wherein the protrusion is positioned between the collar and the core segment.

5. The apparatus of claim 3 wherein the shaft further comprises a second annular recess to receive the protrusion.

6. The apparatus of claim 3 wherein the protrusion acts as a bearing about which the shaft rotates.

7. The apparatus of claim 1 wherein the core segment includes a roll of stock material.

8. The apparatus of claim 1 wherein the collar is substantially a circular ring comprised of two collar segments that are releasably mateable.

9. The apparatus of claim 8 wherein the collar comprises two semicircular collar segments that are releasably mateable.

10. The apparatus of claim 1 wherein the collar has an outer diameter that is larger than the outer diameter of the portion of the shaft positioned between the annular recess and the core segment.

11. An apparatus for dispensing a roll of material with one hand, the apparatus comprising:

a shaft comprising a core segment for supporting a roll of material and a handle segment integral with the core segment, the handle segment comprising a groove and a washer channel, wherein the groove is positioned nearer to the core segment than the washer channel;

an elastomeric washer received in the washer channel; and a gripper received over the handle segment of the shaft, the gripper comprising a cylindrically shaped body defining an open center and having an open upper end and a closed lower end, wherein the open upper end of the gripper is positioned between the elastomeric washer and the core segment, and a portion of the gripper is received in the groove;

wherein the shaft is rotatable relative to the gripper and the gripper is hand-compressible to bring the gripper into frictional contact with the washer to slow or stop the rotation of the shaft.

12. The apparatus of claim 11 wherein the core segment includes a roll of stock material.

13. The apparatus of claim 12 wherein the stock material is a stretch film.

14. The apparatus of claim 11 wherein the shaft is a corrugated paper shaft.

15. The apparatus of claim 11 wherein the groove and the washer channel each extend circumferentially about the outer periphery of the handle segment.

16. The apparatus of claim 11 wherein the groove and the washer channel are both more proximate a generally central portion of the shaft than an end of the shaft.

17. The apparatus of claim 11 wherein the portion of the gripper received in the groove is a protrusion, and the protrusion extends into the open center of the gripper to define a narrower opening therein.

18. The apparatus of claim 11 wherein the elastomeric washer retains the gripper on the handle segment.

19. The apparatus of claim 11 wherein the elastomeric washer is a quarter-quadrant washer.

20. An apparatus for dispensing a roll of material with one hand, the apparatus comprising:

a shaft comprising a core segment for supporting a roll of material and a handle segment, the handle segment comprising a first annular recess and a second annular recess therein;

a collar received in the first annular recess; and a gripper comprising a generally cylindrically shaped body having an open center and an open end, the gripper being positioned on the handle segment with the open end between the collar and the core segment;

wherein the gripper includes a protrusion into the open center received in the second annular recess of the handle segment;

wherein the shaft is rotatable relative to the gripper and the protrusion acts as a bearing about which the shaft rotates; and wherein the gripper is hand-compressible to bring the gripper into frictional contact with the collar to slow or stop the rotation of the shaft.

* * * * *